US010330289B2

(12) United States Patent
Ladstätter

(10) Patent No.: US 10,330,289 B2
(45) Date of Patent: Jun. 25, 2019

(54) COVER FOR THE SUPPORT ARRANGEMENT OF A STRIP LIGHT SYSTEM AND STRIP LIGHT SYSTEM

(71) Applicant: ZUMTOBEL LIGHTING GMBH, Dornbirn (AT)

(72) Inventor: Gerald Ladstätter, Klaus (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 180 days.

(21) Appl. No.: 15/128,259

(22) PCT Filed: Apr. 27, 2015

(86) PCT No.: PCT/EP2015/059082
§ 371 (c)(1),
(2) Date: Sep. 22, 2016

(87) PCT Pub. No.: WO2015/165851
PCT Pub. Date: Nov. 5, 2015

(65) Prior Publication Data

US 2017/0089553 A1 Mar. 30, 2017

(30) Foreign Application Priority Data

Apr. 28, 2014 (DE) ..... 20 2014 101 989 U

(51) Int. Cl.
*F21V 21/00* (2006.01)
*F21S 4/00* (2016.01)
(Continued)

(52) U.S. Cl.
CPC ..... *F21V 21/005* (2013.01); *F21S 4/00* (2013.01); *F21S 4/28* (2016.01); *F21V 3/02* (2013.01);
(Continued)

(58) Field of Classification Search
CPC ..... F21V 21/005
See application file for complete search history.

(56) References Cited

U.S. PATENT DOCUMENTS 3,885,147 A * 5/1975 Chacon ..... A47F 7/00 248/343
5,050,047 A * 9/1991 Viner ..... F21V 21/30 362/125
(Continued)

FOREIGN PATENT DOCUMENTS

DE 7010524 3/1970
DE 1815074 6/1970
(Continued)

OTHER PUBLICATIONS

Austria Search Report Application GM 221/2014 dated Dec. 5, 2014.
(Continued)

*Primary Examiner* — Sharon E Payne
(74) *Attorney, Agent, or Firm* — Andrus Intellectual Property Law

(57) ABSTRACT

The invention relates to a cover for a support arrangement of a strip light system, said support system comprising at least two elongate support rail elements which are arranged behind each other in the longitudinal direction. According to the invention, the cover is formed by an elongate shaped part on which several contact elements which are interconnected by means of at least one cable are arranged, and which are described to make contact by means of the light modules of the strip light system.

10 Claims, 2 Drawing Sheets

(51) Int. Cl.

| | |
|---|---|
| ***F21V 23/06*** | (2006.01) |
| ***F21V 15/01*** | (2006.01) |
| ***F21V 21/005*** | (2006.01) |
| ***F21V 27/00*** | (2006.01) |
| ***F21S 4/28*** | (2016.01) |
| ***F21V 3/02*** | (2006.01) |
| ***F21V 17/16*** | (2006.01) |
| ***F21V 31/00*** | (2006.01) |
| *F21Y 103/00* | (2016.01) |

(52) U.S. Cl.

CPC ..... *F21V 15/01* (2013.01); *F21V 17/164* (2013.01); *F21V 23/06* (2013.01); *F21V 27/00* (2013.01); *F21V 31/005* (2013.01); *F21Y 2103/00* (2013.01)

(56) References Cited

U.S. PATENT DOCUMENTS

| | | | |
|---|---|---|---|
| 5,499,170 | A | 3/1996 | Gagne |
| 5,707,136 | A | 1/1998 | Byers |

FOREIGN PATENT DOCUMENTS

| | | |
|---|---|---|
| DE | 7702596 | 5/1977 |
| DE | 19531407 | 2/1997 |
| DE | 19710291 | 9/1998 |
| DE | 29911453 | 9/1999 |
| DE | 10025646 | 11/2001 |
| DE | 202008003097 | 8/2009 |
| DE | 202010001121 | 8/2010 |
| DE | 202012102874 | 6/2013 |
| DE | 202012101239 | 8/2013 |
| DE | 102012007284 | 10/2013 |
| DE | 102013205934 | 10/2013 |
| EP | 0825688 | 2/1998 |
| EP | 1473807 | 11/2004 |
| GB | 2361988 | 11/2001 |

OTHER PUBLICATIONS

German Search Report Application 20 2014 101 989.8 dated Dec. 16, 2014.

International Search Report PCT/EP2015/059082 dated Jul. 20, 2015.

* cited by examiner

COVER FOR THE SUPPORT ARRANGEMENT OF A STRIP LIGHT SYSTEM AND STRIP LIGHT SYSTEM

CROSS REFERENCE TO RELATED APPLICATION

The present application is the U.S. national stage application of International Application PCT/EP2015/059082, filed Apr. 27, 2015, which international application was published on Nov. 5, 2015 as International Publication WO 2015/165851 A1. The International Application claims priority of German Patent Application 20 2014 101 989.8, filed Apr. 28, 2014.

FIELD OF THE INVENTION

The invention relates to a cover for the support arrangement of a strip light system, as well as a respective strip light system.

BACKGROUND

From prior art, a strip light system is known, which comprises a support arrangement having a plurality of elongated support rail elements arranged next to each other. The support rail elements are profile-shaped and have a basically U-shaped cross section. They are designed to be mounted on a ceiling, either directly or suspended so that the U-shaped support rail opening points downward. Cables for supplying light modules with power are running in the support rail elements, which light modules can be mounted on the support arrangement. The support rail opening can be covered with the light modules and a variety of different cover elements, for example, blank covers.

Usually, the support rail opening is covered at the support arrangement already mounted on the ceiling by an end consumer or user of the strip light system. Because of the fact that typically the support arrangement is of considerable length and a comparatively large variety of cover elements is available, the strip light system can be provided with only a limited protection against dust and moisture. Typically, this problem is especially relevant when using the strip light system in an industrial setting.

SUMMARY OF THE INVENTION

The invention is based on the objective of providing a respectively improved cover or a respectively improved strip light system. In particular, an improved sealing effect shall be provided with the cover or strip light system so that the strip light system offers an improved protection against dust and moisture.

According to the invention, this objective is achieved by means described herein.

According to the invention, a cover for the support arrangement of a strip light system is provided, wherein the support arrangement comprises at least two elongated support rail elements arranged next to each other. At the same time, the cover is formed by a part having an elongated shape on which several contact elements, which are interconnected by means of at least one cable, are arranged and which are designed to make contact by means of the light modules of the strip light system.

By designing the cover in the form of an elongated shape, it is possible to provide an improved seal of the support arrangement. As a result, it is easy to mount the light modules through the contact elements, which are arranged at the shaped part.

Preferably, the shaped part is designed in such a way that it can be wound up into a roll together with the contact elements, which are arranged at the shaped part and connected with it by means of the at least one cable. When it is wound up like that, the shaped part can be easily transported together with the contact elements, especially to the desired installation site, even when it has considerable length.

Preferably, the shaped part has a length which, at least basically, corresponds to the sum of lengths of the support rail elements. In this way, it is not necessary to cover the support arrangement by means of several individually shaped parts. Using several individually shaped parts would inevitably result in the fact that along the longitudinal direction butt joints would be formed, which present potential leakage points.

Preferably, the shaped part has openings into which the contact elements are inserted in such a way that they can be contacted from a side which, in relation to the shaped part, is located opposite to the at least one cable. This allows for a particularly suitable connection between the shaped part and the contact element. Preferably, the contact elements are clamped or snapped into the openings. This allows for an easy assembly of the contact elements.

Preferably, sealing components are arranged on a side which, in relation to the shaped part, is located opposite of the at least one cable. Said sealing components are designed to respectively revolve, preferably in closed condition, about the contact elements. As a result, an especially suitable seal can be formed between the shaped part and elements, which are provided to be connected from the outside with the contact elements.

According to a further aspect of the invention, a strip light system is provided, which comprises a support arrangement having at least two elongated support rail elements arranged next to each other. Furthermore, the strip light system comprises an invention-based cover, which is arranged in a support rail opening formed by means of the support rail elements.

Preferably, the strip light system is designed in such a way that the shaped part is connected with the support arrangement by means of a clamp or snap-on connection. As a result, a suitable seal can be provided along with an easy to mount possibility.

Preferably, the strip light system also comprises a further shaped part, which is connected in form-fit manner with the first shaped part in such a way that an elongated receiving space is formed by the two shaped parts, wherein the at least one cable is arranged in the receiving space. As a result, the at least one cable is especially protected. Preferably, the two shaped parts are designed in such a way that the receiving space extends at least essentially at least across the length of the support rail elements.

Preferably, the strip light system also comprises an element, in particular in the form of a lamp or a light module or a plug or a blank cover, which is provided to be tightly connected from the outside with one of the contact elements. As a result, an especially suitable seal can be provided in the region of the contact elements. Especially preferred, the element comprises a sealing component for forming a seal between the element and the shaped part.

Preferably, the strip light system is designed in such a way that the support rail elements have surfaces for a mounting bracket of the element. As a result, the strip light system is especially suited for installing respective elements, which have a comparatively large weight.

Preferably, the number of contact elements is identical with the number of the elements, wherein each element is tightly connected with one of the contact elements. In this way, an especially suitable seal can be formed.

BRIEF DESCRIPTION OF THE DRAWINGS

Subsequently, the invention is described in more detail by means of an embodiment and with reference to the drawings. It is shown:

FIG. 3 shows a drawing of a longitudinal section through the strip light system.

DETAILED DESCRIPTION

Figure 1:
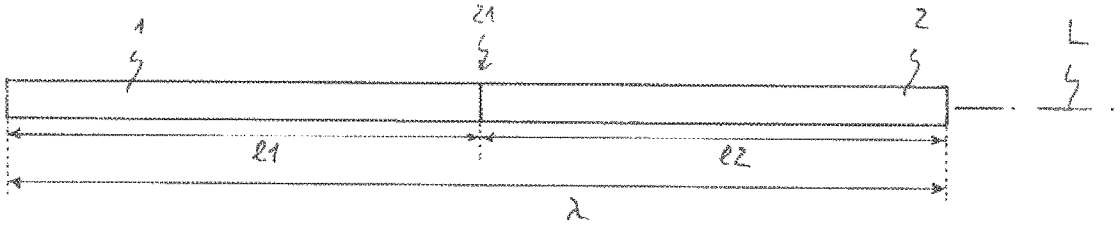
FIG. 1 shows a diagram of a lateral view of an invention-based strip light system.

FIG. 1 shows a diagram of a lateral view of an invention-based strip light system. The strip light system comprises a support arrangement, which has at least two elongated support rail elements 1, 2 arranged in a longitudinal direction next to each other. Accordingly, the support rail elements 1, 2 extend along a longitudinal axis L, wherein they are arranged adjoining each other, thus forming a butt joint 21. In the example shown, the support rail elements 1, 2 are designed in the form of shaped parts having identical cross sections, wherein the shaped axes are aligned in parallel to the longitudinal axis L.

Preferably, the support rail elements 1, 2 are produced from a firm material, for example, a metal, such as aluminum. For example, the support rail elements 1, 2 can be produced from bent sheet metal.

In general, the support arrangement can comprise more than two support rail elements 1, 2, each of which is designed and arranged in a similar manner, namely in such a way that the support rail elements of the support arrangement are arranged next to each other along the longitudinal axis L. Therefore, it is sufficient for reasons of simplicity to describe the case in which the support arrangement has the two support rail elements 1, 2 shown.

Figure 2:
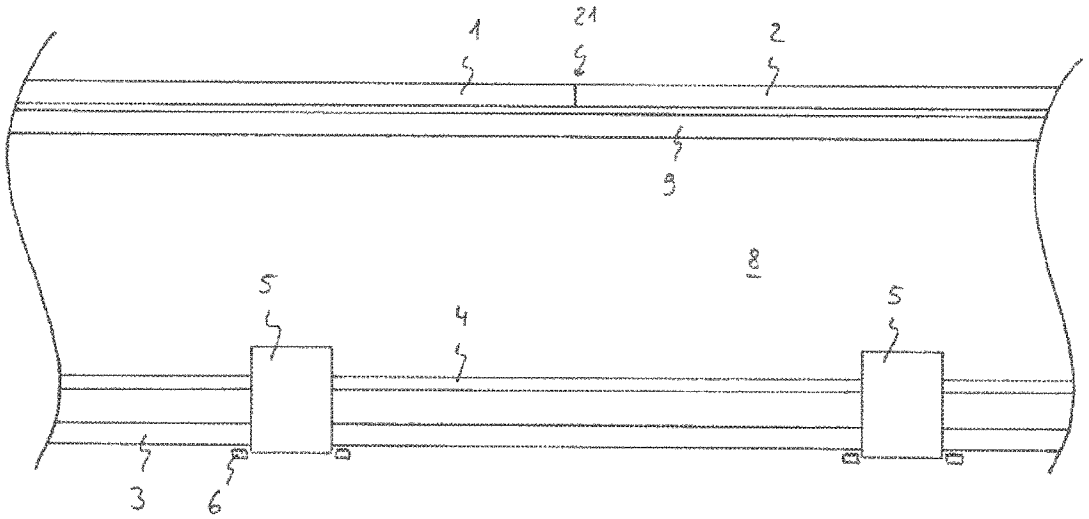
FIG. 2 shows a cross section through the strip light system and the invention-based cover for the support arrangement of the strip light system.
Figure 2:
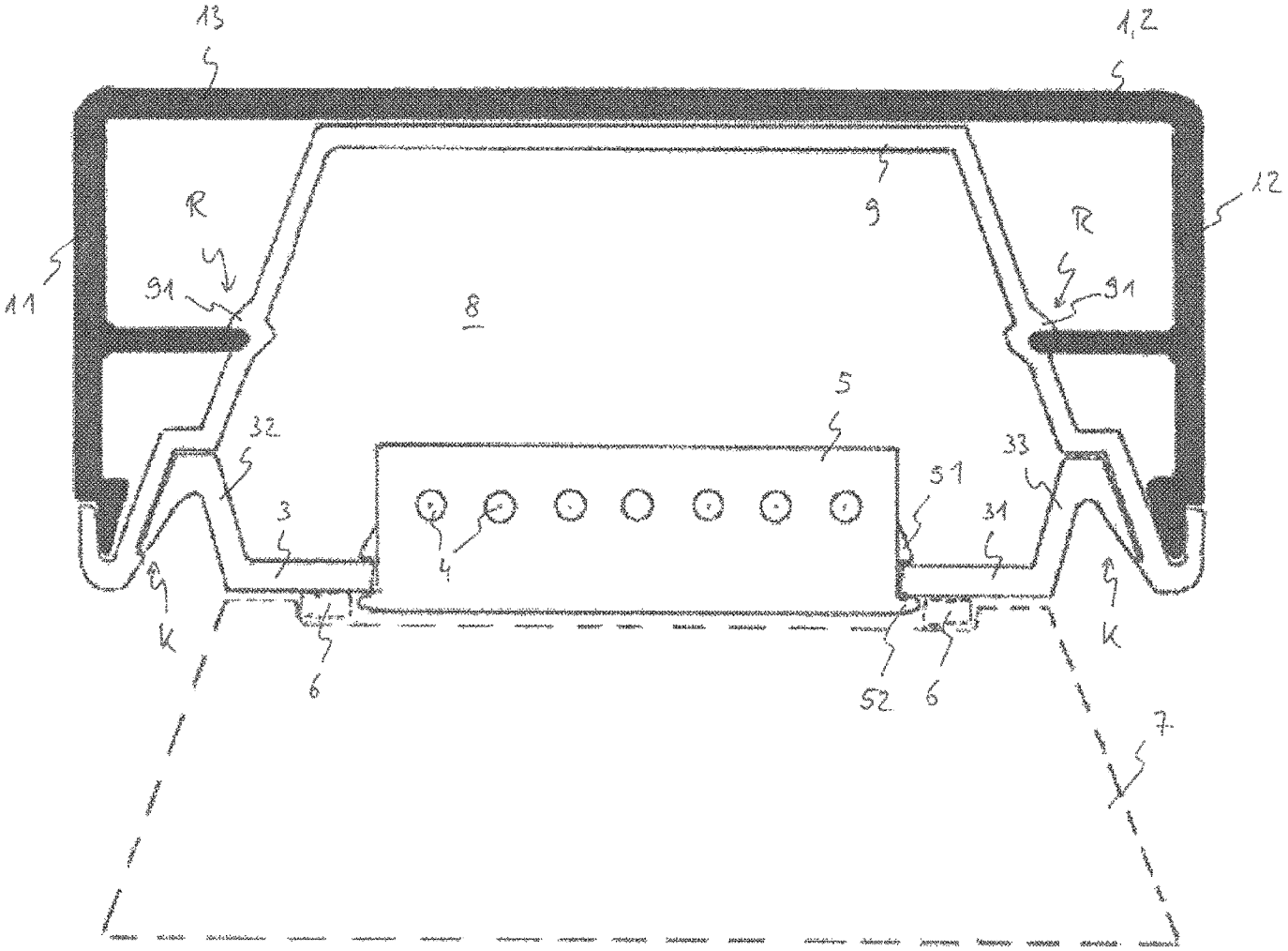

FIG. 2 shows a cross section through the strip light system, usually in relation to the longitudinal axis L. A support rail opening is formed through the support rail element 1, 2. In the example shown, the support rail elements 1, 2 comprise a basically U-shaped cross section, forming a first U-shaped bracket 11, a second U-shaped bracket 12 and a connecting bracket 13, which connects the two U-shaped brackets 11, 12. The two U-shaped brackets 11, 12 and the connecting bracket 13 define an interior space of the support rail elements 1, 2. The support rail opening is restricted by the two free end regions of the U-shaped brackets 11, 12.

Here, it is assumed that the support rail elements 1, 2 are aligned in such a way that the two U-shaped brackets 11, 12 point downward, i.e., the support rail opening is pointing downward. However, this should be considered only as an example, it is also possible to use a different alignment in relation to the vertical alignment.

In the support rail opening, a cover is arranged, which is formed by a part having an elongated shape 3. Preferably, the shaped part 3 comprises an elastic material, in particular a material that is more elastic than the support rail elements 1, 2. In this way, it can be achieved that by means of the shaped part 3 the interior space of the support rail elements 1, 2 can be appropriately closed to be protected against any infiltration of dust or moisture.

At the shaped part 3, several contact elements 5, which are interconnected by means of at least one cable 4, are arranged, which contact elements 5 are designed to be contacted by light modules of the strip light system. In particular, the contact elements 5 can be designed to supply the light modules of the strip light system with power and/or to transmit control signals. Preferably, the contact elements 5 involve contact sockets.

FIG. 3 shows a diagram of a longitudinal section through the strip light system. In the section shown two of the contact elements 5 can be seen. The at least one cable 4 extends on a first side of the shaped part 3, in the orientation shown here above the shaped part 3. In particular, the at least one cable 4 can extend in the interior space of the support rail elements 1, 2.

Preferably, the shaped part 3 is designed in such a way that it can be wound up into a roll together with the contact elements 5, which are arranged at the shaped part and connected with it by means of the at least one cable 4. When it is wound up like that, the shaped part can be easily transported together with the contact elements 5, especially to the desired installation site, even when it has a comparatively large length, for example, longer than 5 m or longer than 10 m. For example, it can be provided that, without being damaged, the shaped part 3 together with the contact elements 5 and the at least one cable 4 can be wound up into a roll, which has a diameter of less than 2 m.

Preferably, the shaped part 3 has a length $\lambda$, which at least basically corresponds to the sum of the lengths $l1$, $l2$ of the support rail elements 1, 2. In this way, it can be achieved that across the entire length $\lambda$ the shaped part 3 would not form any butt joint, which would present a potential leakage point. In this case in particular, the shaped part 3 extends advantageously across the butt joint 21.

In the example shown, the shaped part 3 has openings in which the contact elements 5 are inserted in such a way that they can be contacted from a side which, in relation to the shaped part 3, is located opposite to the at least one cable 4, here also depicted as second side, i.e., in the orientation shown from below or in relation to the interior space restricted by the support rail elements 1, 2 from the outside.

Preferably, the openings are designed in such a way that they are at least essentially closed by the inserted contact elements 5.

In particular, the contact elements 5 extend downward and upward beyond the shaped part 3, preferably less downward than upward because, in this way, it is possible to form an especially suitable connection between the contact elements 5 and the at least one cable 3.

Basically, it is possible to use different techniques for connecting the contact elements 5 with the shaped part 3. For example, it can be provided that the contact elements 5 are clamped or snapped into the openings. As a result, a simple and reliable connection can be formed between the contact elements 5 and the shaped part 3.

For example, FIG. 2 indicates that each of the contact elements 5 has at least one snap-on element 51 and at least one stop element 52, wherein preferably the snap-on element 51 is spring-mounted and forms a counter-element for the non-resilient stop element 52. For mounting purposes, it can be provided that when inserted the snap-on element 51 is attached to one side of the shaped part 3 and the stop element 52 to the respectively opposite side.

Preferably, the at least one stop element 52 is designed in such a way that it forms a closed circumference and covers the entire edge of the respective opening from below. This is of great advantage for appropriately sealing the interior space.

The example shown is designed in such a way that the contact elements 5 can be respectively inserted from below into one of the openings of the shaped part 3 until the respective stop element 52 comes from below into contact with the shaped part 3. During this movement, the snap-on element 51 is initially deflected through the edge of the respective opening to the inside and then snaps above the edge again to the outside, so that it serves together with the stop element 52 as a mounting bracket for the respective contact element 5 on the shaped part 3.

Preferably, the number of openings of the shaped part 3 is identical with the number of contact elements 5, wherein exactly one of the contact elements 5 is inserted in each of the openings. In other words, each of the openings is closed by one of the contact elements 5.

For production purposes, it can be provided that in a first step the contact elements 5 are connected with the shaped part 3, as described above, and then the individual contact elements 5 are connected with each other by means of the at least one cable 4. Preferably, it is provided that the contact elements 5 are not connected through individual cables, which respectively extend between two adjoining contact elements 5, but that the at least one cable 4 is long enough to extend across all contact elements 4, wherein the at least one cable 4 is stripped in the region of the respective contact element 5, thus allowing for an appropriate electrical contact.

To further improve the seal, it can be provided that on one side which, in relation to the shaped part 3, is located opposite of the at least one cable 4, here on the bottom side of the shaped part 3, sealing components 6 are arranged, which are formed preferably as a closed circumference about the respective contact element 5. For example, it is possible to provide for each of the openings such a sealing component 6, which revolves about the outer edge of the stop element 52.

As shown in the example, the strip light system preferably comprises a further shaped part 9, which is tightly connected in form-fit manner with the first shaped part 3 in such a way that an elongated receiving space 8 is formed through the two shaped parts 3, 9, wherein the at least one cable 4 is arranged in the receiving space 8. Advantageously, the form-fit connection allows for an appropriate seal between the two shaped parts 3, 9.

Preferably, the further shaped part 9 comprises at least or exactly the same length as the first shaped part 3. As a result, the receiving space 8 can be appropriately sealed. Advantageously, the further shaped part 8 also has an elastic design.

By means of the two shaped parts 3, 9, it is possible to form a two-part continuous duct. To form a complete seal, it is only required to provide an appropriate seal at the two frontal regions of the receiving space 8. Well-known technologies can be used for this purpose.

In particular, the two shaped parts 3, 9 can be designed in such a way that the receiving space 8 extends at least essentially at least across the length of the support rail elements 1, 2, i. e., across the sum of the lengths l1, l2 of the support rail elements 1, 2.

With regard to the sealing of the receiving space 8, it is also advantageous that the shaped part 3 is connected with the support arrangement by means of a clamp or snap-on connection, especially merely by the clamp connection or the snap-on connection. Basically, it can be provided that the shaped part 3 directly adjoins the support rail elements 1, 2 or, as shown in the example, by inserting a further shaped part 9.

Preferably, the further shaped part 9 is retained by means of a snap-on connection R on the support rail elements 1, 2. This is especially easy to assemble. Preferably, the further shaped part 9 is appropriately shaped 91 for this purpose. For an easy assembly, the first shaped part 3 can be retained by means of a clamp connection on a further shaped part 9. Also for this purpose, respective shapes can be designed on the shaped part 3 and/or on the further shaped part 9. As a result, an especially tight connection can be made between the two shaped parts 3, 9.

For example, a suitable stability and tightness can be achieved can be achieved when the shaped part 3 comprises in a central region a preferably panel-shaped base area 31, the edges of which respectively adjoin a connecting area 32, 33, wherein the base area 31 comprises a stronger material than the connecting areas 32, 33. Preferably, the openings into which the contact elements 5 are inserted are merely formed into the base area 31. Preferably, the connecting areas 32, 33 have a respective U-shaped or V-shaped cross section.

An especially suitable stability can be achieved when the connecting areas 32, 33 push against the end regions of the two U-shaped brackets 11, 12 of the support rail elements 1, 2, either directly or by inserting regions of the further shaped part 9, as shown in an exemplary manner in FIG. 2.

A potential leak of the interior space occurs essentially not only in the area between the circumference of the contact elements 5 and the respective edges of the openings, but also through the contact path, which is formed by the contact elements 5 between the outer region and the interior space. Even in this way, an achievement of the desired degree of protection can be jeopardized. However, this path can be tightly closed from the outside by using a respective cover of the contact elements 5.

As indicated in FIG. 2, the strip light system preferably comprises a further element 7, in particular in the form of a lamp or a light module or a plug or a blank cover, which is provided to be tightly connected from the outside with one of the contact elements 5. Preferably, the design involves that the element 7 completely overlaps the respective contact element 5 when it is connected as intended with the contact element 5.

Essentially, it could also be provided that the element 7 is designed in the form of a socket which can then be engaged with a contact element designed in the form of a plug. However, with regard to protecting the electrical connecting path, it is usually better to design the contact elements 5 in the form of sockets.

For example, a respective plug could involve the plug of a lamp or any other electricity consuming device.

In particular, the design involves that through the contact elements 5 a respective electrical connection is established between the respective plug and the respective stripped place of the at least one cable 4.

Alternatively, or in addition to the above-mentioned sealing components 6, it can be provided that the element 7 comprises a sealing component for forming a seal between the element 7 and the shaped part 3. Also in this way, it is possible to achieve an appropriate seal.

To appropriately seal the interior space of the support rail elements 1, 2 or receiving space 8, it is provided that all contact elements 5 are covered by a respective element 7. In particular, it is possible to provide for those contact elements 5 which are not electrically connected with a plug blank covers or blank caps or elements which, when they are connected with the respective contact element 5, do not form any electrical connection with the at least one cable 4. As a result, it is possible to achieve from the bottom side of the strip light system a complete seal.

Because of the fact that in the example shown the shaped part 3 has an elastic design, the capability of the shaped part 3 to bear the element 7 is to a certain extent restricted. Therefore, the element 7 to be used should involve an element which does not exceed a certain weight, for example, a small lamp or a blank cap.

However, it can also be provided that the support rail elements 1, 2 have surfaces for a mounting bracket of the element 7. In this way, the element 7 can be appropriately mounted when it has a larger weight. This design allows for an alternative or additional mechanical mounting bracket of the element 7. For example, it can be provided that the U-shaped brackets 11, 12 of the support rail elements 1, 2 have respective section reinforcements or the like, which allow for interlocking with respective retainers of the element 7.

The invention-based cover provides an end user with a simple on-site assembly. In particular, he does not have to connect individual contact elements with a respective shaped part but can simply attach the cover directly at the bottom side of the support rail elements 1, 2. As a result, it is possible to achieve a suitable tightness of the interior space of the support rail elements 1, 2, in that the at least one cable 4 is appropriately protected against dust and moisture. Especially suitable is the embodiment involving the further shaped part 9, which together with the first shaped part 3 forms the sealed receiving space 8.

In particular, a higher degree of protection can be achieved with the respective strip light system. For example, this is extremely advantageous in the case of industrial applications.

What is claimed is:

1. A strip light system comprising:

a support arrangement comprising at least two elongated, U-shaped support rail elements (1, 2), which are arranged next to each other end to end in a longitudinal direction;

a cover arranged in an elongated opening formed by the support rail elements (1, 2), wherein the cover comprises an elongated shaped part (3) on which several contact elements (5), interconnected by means of at least one cable (4), are arranged and which are configured to make contact with light modules of the strip light system, wherein the elongated shaped part is made of one or more materials that are more elastic than the support rail elements and the elongated shaped part (3) has openings into which the contact elements (5) are inserted in such a way that they can be contacted with the light modules from a side which, in relation to the elongated shaped part (3), is located opposite to the at least one cable (4) and wherein the contact elements (5) are clamped or snapped into the openings; and further wherein each contact element includes a stop element (52) that forms a closed circumference around the contact element (5) and covers the edge of the respective opening in the elongated shaped element (3), and a snap-on element (51) which is configured to be on one side of the elongated shaped element with the stop element (52) on the other side of the elongated shaped element (3) when the contact element (5) is inserted into the respective opening in the elongated shaped element (3).

2. The strip light system according to claim 1, wherein the elongated shaped part (3) is designed in such a way that it can be wound up into a roll together with the contact elements (5), which are arranged at the shaped part (3) and connected with it by means of the at least one cable (4).

3. The strip light system according to claim 1, further comprising sealing components (6) arranged on a side which, in relation to the shaped part (3), is located opposite of the at least one cable (4), which sealing components each form a closed circumference about the respective contact element (5).

4. The strip light system according to claim 1, further comprising a further elongated shaped part (9), which is connected in form-fit manner with the first elongated shaped part (3) in such a way that an elongated receiving space (8) is formed by the two elongated shaped parts (3, 9), wherein the at least one cable (4) is arranged in the elongated receiving space (8).

5. The strip light system according to claim 4, wherein the two elongated shaped parts (3, 9) are designed in such a way that the elongated receiving space (8) extends at least essentially at least across the length of the support rail elements (1, 2).

6. The strip light system according to claim 1, further comprising at least one element (7) in the form of a lamp or a light module or a plug or a blank cover, which is provided to be tightly connected from the outside with one of the contact elements (5).

7. The strip light system according to claim 6, wherein the element (7) comprises a sealing component for forming a seal between the element (7) and the shaped part (3).

8. The strip light system according to claim 6, wherein the support rail elements (1, 2) have surfaces for a mounting bracket of the element (7).

9. The strip light system according to claim 6, wherein the number of contact elements (5) is identical with the number of the elements (7), and wherein each element is tightly connected with one of the contact elements (5).

10. A strip light system as recited in claim 1 wherein the elongated shaped part includes a panel-shaped base that extends longitudinally along the elongated shaped part and through which the openings located, and longitudinally running connecting areas on either side of the panel-shaped base which are adjoined the panel-shaped base, and wherein the cover is held in place across the support rail opening, at least partially by pushing the connecting areas against end regions of the respective support rail elements.

* * * * *